US005413273A

United States Patent [19]

Money

[11] Patent Number: 5,413,273

[45] Date of Patent: May 9, 1995

[54] MERCHANDISE CONTAINERS

[75] Inventor: Julian D. Money, Richmond, United Kingdom

[73] Assignee: M-Pak Limited, London, England

[21] Appl. No.: 122,509

[22] PCT Filed: Jul. 15, 1993

[86] PCT No.: PCT/GB93/01489

§ 371 Date: Sep. 24, 1993

§ 102(e) Date: Sep. 24, 1993

[87] PCT Pub. No.: WO94/02363

PCT Pub. Date: Feb. 3, 1994

[30] Foreign Application Priority Data

Jul. 28, 1992 [GB] United Kingdom ..... 9216024
Oct. 28, 1992 [GB] United Kingdom ..... 9222754

[51] Int. Cl.[6] ..... B65D 5/08; B65D 5/478; B65D 5/10

[52] U.S. Cl. ..... 229/128; 229/138; 229/143; 229/149

[58] Field of Search ..... 229/137, 138, 143, 149, 229/128

[56] References Cited

U.S. PATENT DOCUMENTS

| | | | |
|---|---|---|---|
| 667,634 | 2/1901 | Schmidt | 229/128 |
| 2,329,797 | 9/1943 | Strack | 229/128 |
| 2,439,435 | 4/1948 | Richardson et al. . | |
| 3,526,352 | 9/1970 | Swett | 229/138 |
| 3,750,932 | 8/1973 | Ellison . | |
| 4,535,928 | 8/1985 | Capo | 229/138 |
| 4,784,497 | 11/1988 | Dutton | 383/43 |
| 4,969,596 | 11/1990 | Schulbaum | 229/138 |

FOREIGN PATENT DOCUMENTS

| | | |
|---|---|---|
| 357919 | 3/1929 | Belgium . |
| 276893 | 8/1988 | European Pat. Off. . |
| 2601332 | 1/1988 | France . |
| 9216873 | 2/1993 | Germany . |
| 8801184 | 12/1989 | Netherlands . |
| 843778 | 8/1960 | United Kingdom . |
| 4784497 | 11/1988 | United Kingdom . |

*Primary Examiner*—Gary E. Elkins
*Attorney, Agent, or Firm*—Fish & Richardson

[57] ABSTRACT

The disclosure relates to a merchandise container formed from folded flexible sheet material to provide a box form having side/end walls (10, 11) and a top closure (13), in which the top closure comprises integral flaps (17, 19) on the side/end walls which fold with respect to each other and the walls. The end walls (13–17) being pre-formed to bow inwardly such that when the side wall flaps (17*a*, 17*b*) are folded in overlapping relation to form the top closure, the end wall flaps (19) form outwardly extending triangular wings which fold downwardly against an increasing resistance until a certain downwardly inclined angle below the horizontal is reached when the end walls bow inwardly allowing the side walls to converge to relieve the resistance and create a force tending to bias the wings downwardly into engagement with the end walls to hold the wings against the end walls and the side wall flaps of the top closure in the closed condition.

13 Claims, 23 Drawing Sheets

14
12
17
17
20
16
26
21
20
13
26
19
15
22
14
18
11
22

25
19
23

MERCHANDISE CONTAINERS

This invention relates to merchandise containers and is applicable to both pre-packed containers and to containers intended to receive goods at "point of sale".

This invention provides a merchandise container formed from folded flexible sheet material to provide a box form having side/end walls and a top closure, in which the top closure comprises integral flaps on the side/end walls which fold with respect to each other and the walls, the end walls being pre-formed to bow inwardly such that when the side wall flaps are folded in overlapping relation to form the top closure, the end wall flaps form outwardly extending triangular wings which fold downwardly against an increasing resistance until a certain downwardly inclined angle below the horizontal is reached when the end walls bow inwardly allowing the side walls to converge to relieve the resistance and create a force tending to bias the wings are then biassed downwardly into engagement with the end walls to hold the wings against the end walls and the side wall flaps of the top closure in the closed condition.

Preferably the end walls of the container have crease lines to allow the walls to adopt an inwardly bowed concave formation as the wings are folded through said downwardly inclined angle thereby drawing the side walls of the upper part of the container towards one another and biassing said wing portions towards the side walls.

More specifically the end walls of the container may have central crease lines extending downwardly from the upper edges of the flaps to facilitate an initial prebowing inwardly of the end walls prior to the forming and downward folding of said wing portions.

It is preferred that said central crease lines extend to the bottoms of the end walls.

It is also preferred that said central crease lines are perforated at least through the top flaps of the end walls. More specifically the central crease lines may be perforated at least part-way down the end walls.

In accordance with a further feature of the invention the end walls of the container may have further crease lines extending from the lower corners thereof upwardly and inwardly to meet said central crease lines at an apex. For example said further crease lines extend at 45° to the bottom edges of the end walls.

The central crease lines may be perforated down to said apex with the further crease lines. Alternatively the central crease lines may be perforated down to a location above the apex with said further crease lines.

In any of the above arrangements cut/score lines may be formed between the top flaps and end walls to weaken substantially the resistance to folding of the top flaps.

Also, in any of the above arrangements the end wall flaps may be each formed with a triangle of pre-creased fold lines to facilitate formation of said triangular shaped wing portions when the side wall flaps are folded together.

In accordance with a further preferred feature, notches may be cut at the corners between the uppermost side wall flap and adjacent end wall flap thereby to facilitate sliding of the upper side wall flap over the lower side wall flap and to facilitate movement of the sides of the container towards each other as the end walls of the container bow inwardly when the wing portions are folded downwardly.

The flap portions may have integral tongues which project above the edges of the adjacent wing portions prior to folding of the flaps/wings, the tongues overlapping one another when the flaps are folded downwardly and inwardly to create the top closure of the container.

In any of the above arrangements the sheet material of the container may be a stiff paper, card or plastic sheet.

The following is a description of some specific embodiments of the invention, reference being made to the accompanying drawings in which.

Figure 13:
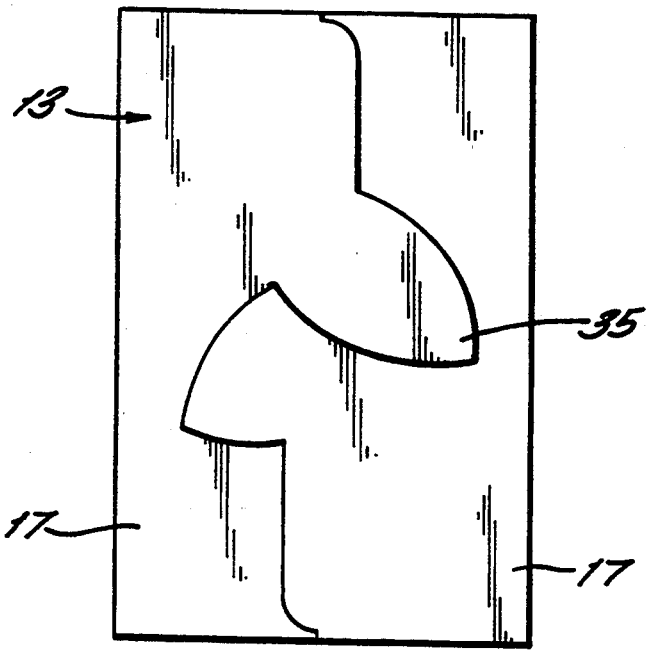

FIGS. 12*a* to 12*d* show the sequence of operations in closing the container top;

FIG. 13 shows a further variant of the top closure provided with a top interlock; and FIGS. 14 to 27 illustrate various further arrangements.

Figure 1:
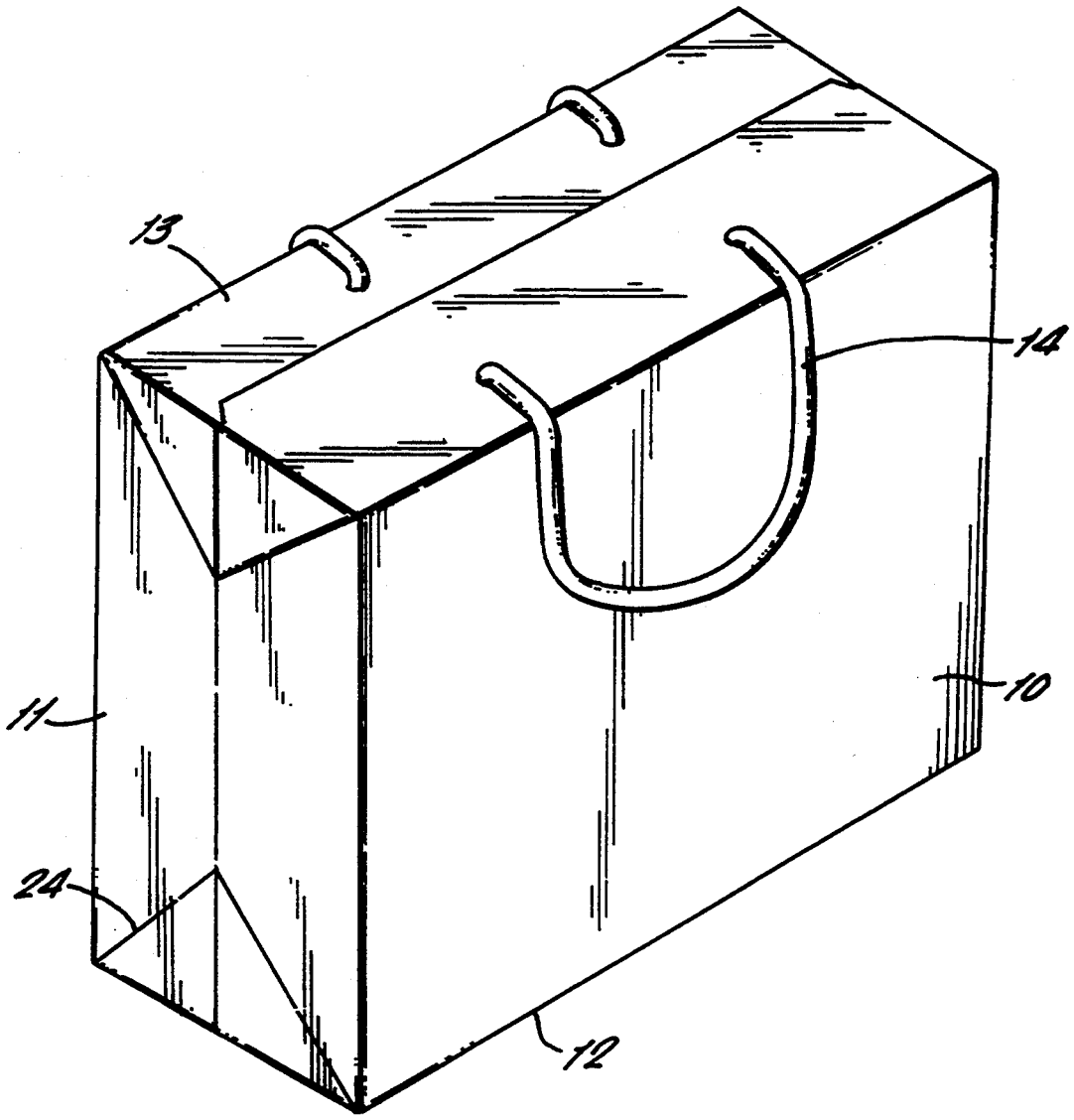
FIG. 1 is a perspective view of a box form carrier bag having a top closure in accordance with the invention.
Figure 5:
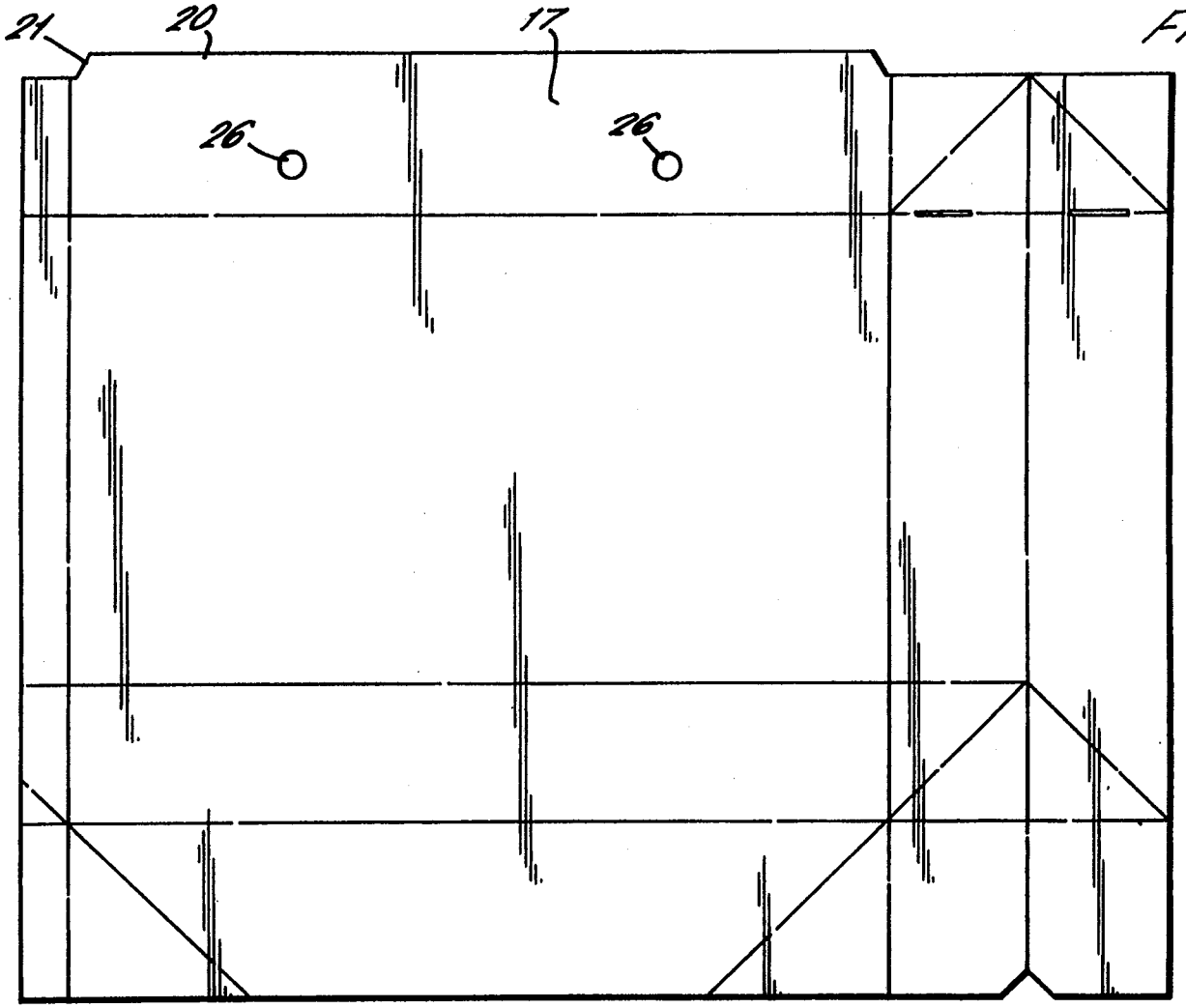
FIG. 5 is a plan view of one of two identical blanks of sheet material from which the container of FIGS. 1 to 4 is formed.

Referring firstly to FIG. 1 of the drawings, there is shown a box form carrier bag of elongate rectangular section having side walls 10, end walls 11, bottom closure 12, a top closure 13 and loop form rope carrier handles 14 attached to the top wall portion for carrying the bag. The bag is formed from two sheets of card, stiff paper or plastics material having the blank form illustrated in FIG. 5 creased, folded and glued to create the bag illustrated in FIG. 1. In the case where the blanks are formed from paper or sheet plastics material, the portions of the blanks forming the top closure may be reinforced with card or other stiffening material.

Figure 2:
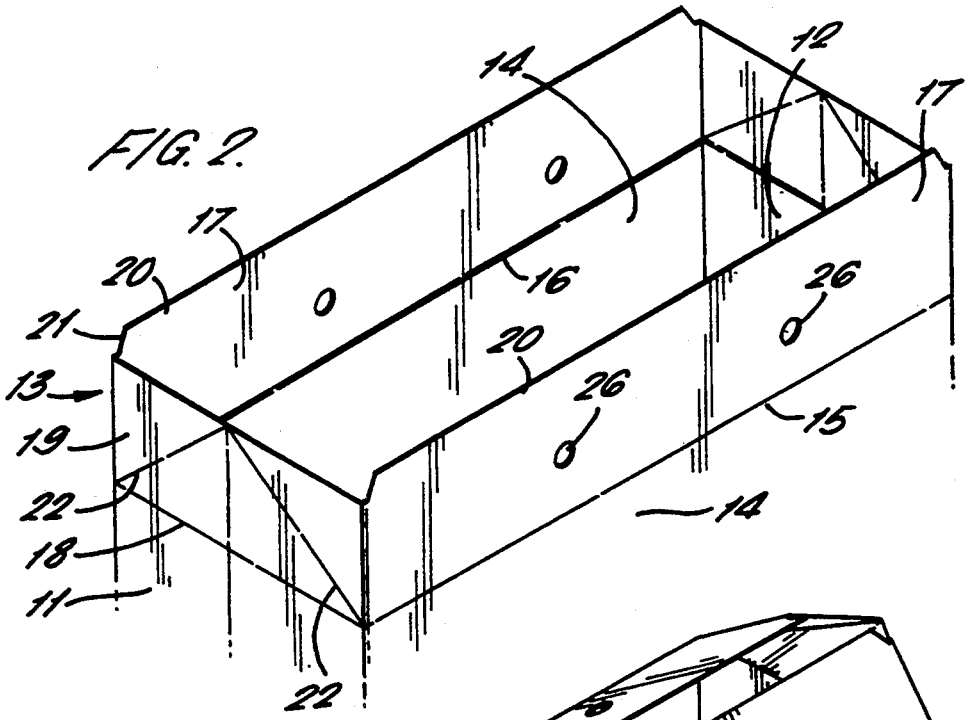
FIG. 2 is a perspective view of a part of the bag with the top closure in the fully open condition.
Figure 4:
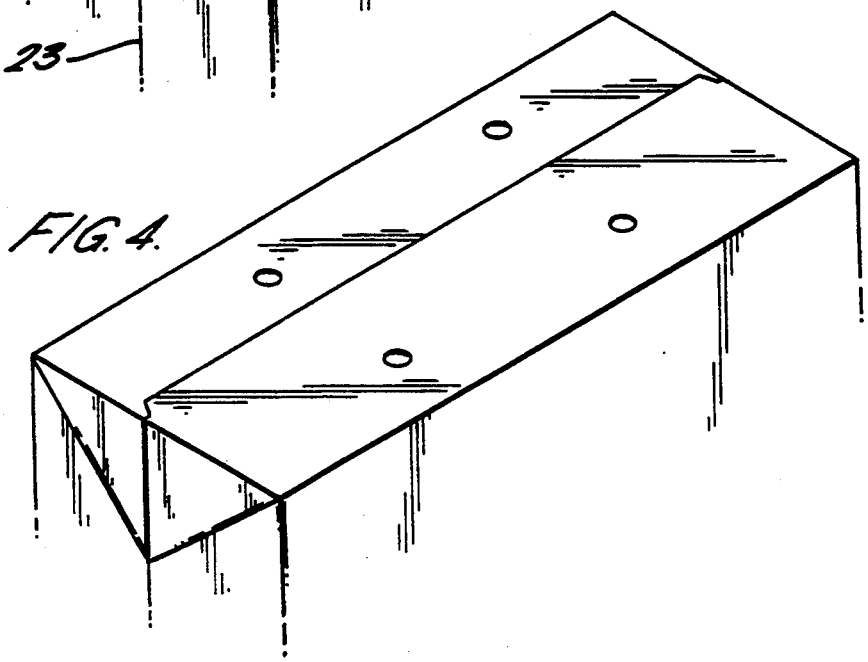
FIG. 4 is a similar view to that of FIGS. 2 and 3 with the top closure fully closed.

The top closure of the bag will now be described with reference to FIGS. 2 and 4. The upper portions of the side walls 14 are folded/creased along lines 15 to form flap portions 17 and, similarly, the upper portions of the end walls 11 are folded at 18 to form wing portions 19. The flap portions have integral tongues 20 extending above the wing portions which overlap when the flap portions are folded together as described below and the corners of the tongues are cut away at an angle as indicated at 21.

Figure 3:
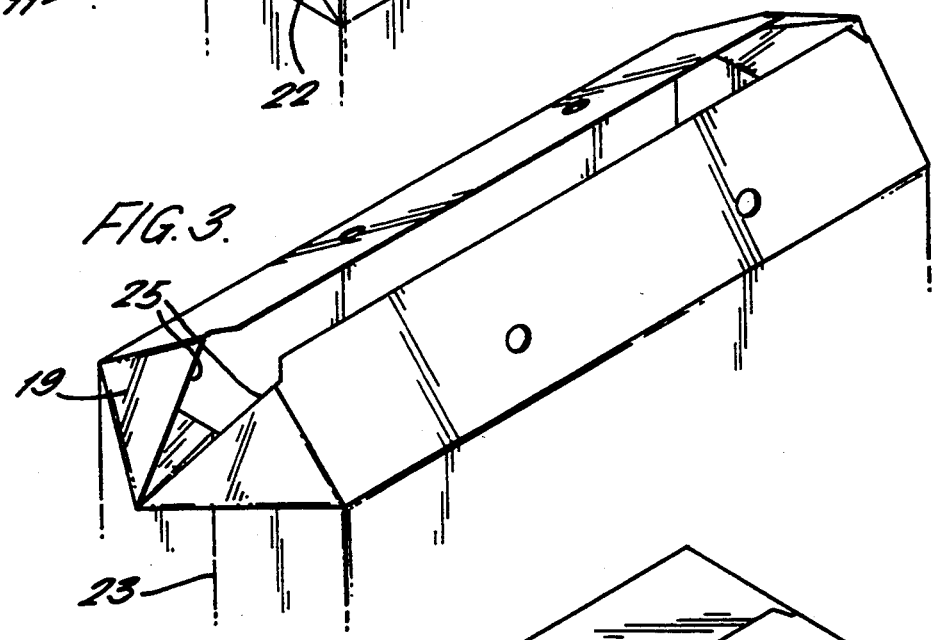
FIG. 3 is a similar view to FIG. 2, with the top closure partly closed.

The wing portions 19 are formed to fold outwardly into triangular shaped flaps by provision of creases 22 formed in the flap portions extending from the upper corners of the end walls to the centre of the upper edge of each end flap portion. Thus, when the wing portions are folded outwardly and downwardly as indicated in FIG. 3, each wing forms into a double-walled triangular shape, a lower wall of which is connected to the end wall and the upper wall of which is connected to the flap portions 17.

Folding the triangular shaped wing portions 19 outwardly and downwardly is met with an increasing resistance as the flap portions are drawn together to close the top of the container with the tongues 20 thereon overlapping. The resistance increases as the wing portions move through the horizontal to a point at which they are angled downwardly from the horizontal where it is a maximum and below which the resistance diminishes as the wing portions fold into engagement with the end walls of the container. The arrangement thus provides an "over-centre" action in the folding of the flaps. Once the wing portions have been folded past the point of greatest resistance or "over-centre", they are biassed automatically towards the end walls of the container and thereby resist inadvertent opening of the container.

The end walls of the container are pre-formed to develop a slight concavity as the wings are folded downwardly by means of a vertical centre line crease 23 extending down the end walls to meet two divergent creases indicated at 24 on FIG. 1 which extend to the bottom corners of the blank. This slight concavity receives the downwardly folded wing portions 19 so that they lie approximately in planes containing the perimeter of the end walls, that is substantially flush with the ends of the container. In the fully folded condition either edge 25 of one part of the wing 19 may tuck slightly behind the corresponding edge 25 of the opposing part to provide a further resistance against unfolding and release of the top opening.

The flap portions 17 are each provided with spaced holes 26 positioned where appropriate to receive rope handles 14 as illustrated in FIG. 1. The ends of the rope handles are passed through the holes and formed with stop knots to maintain the ends on the flap portion for carrying the bag.

Finally, the bottom closure of the container is formed in any conventional manner with overlapping flaps on the sides and end walls inter-locked and/or glued together.

It will be appreciated that the bag can be supplied for use (e.g. a point of sale location) in flat or collapsible form to be erected immediately prior to use as required.

Figure 6:
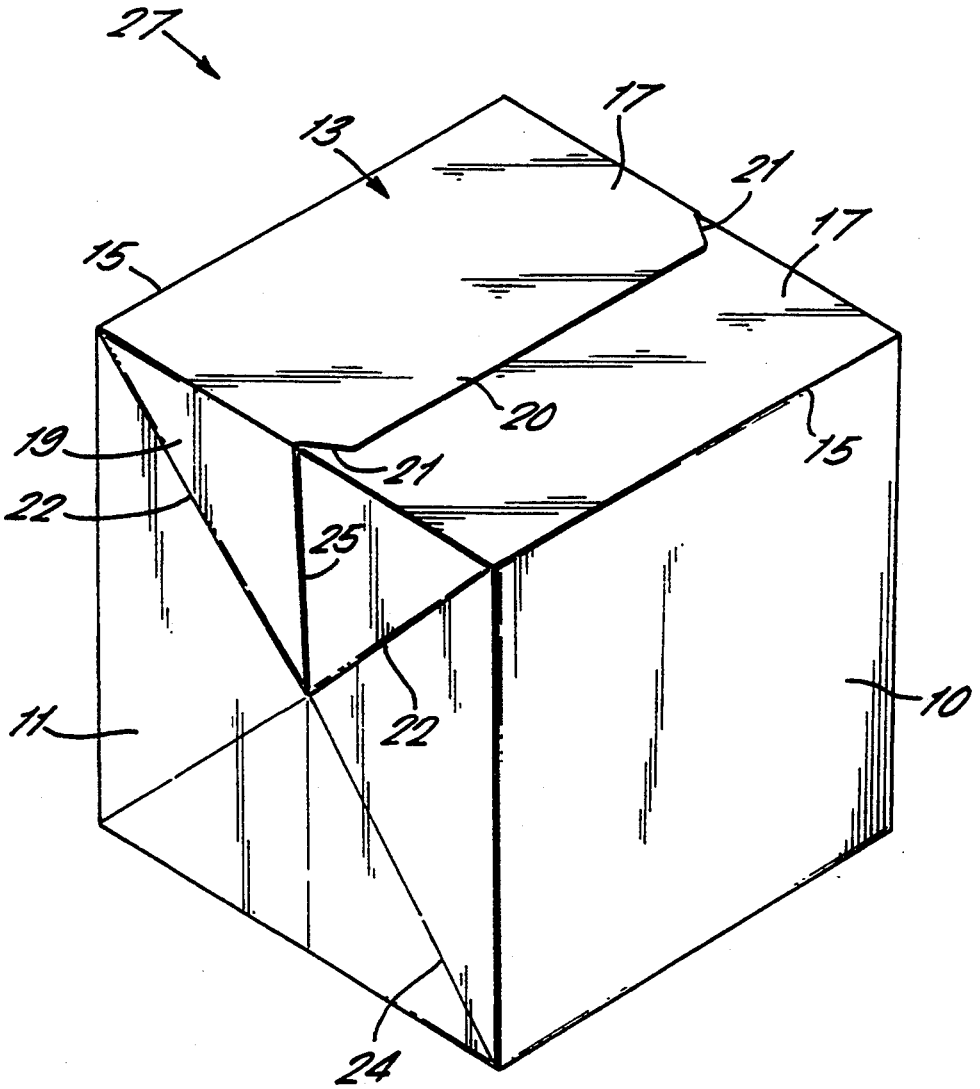
FIG. 6 is a perspective view of a cubic form carton embodying a similar top closure to that of FIGS. 1 to 5.
Figure 7:
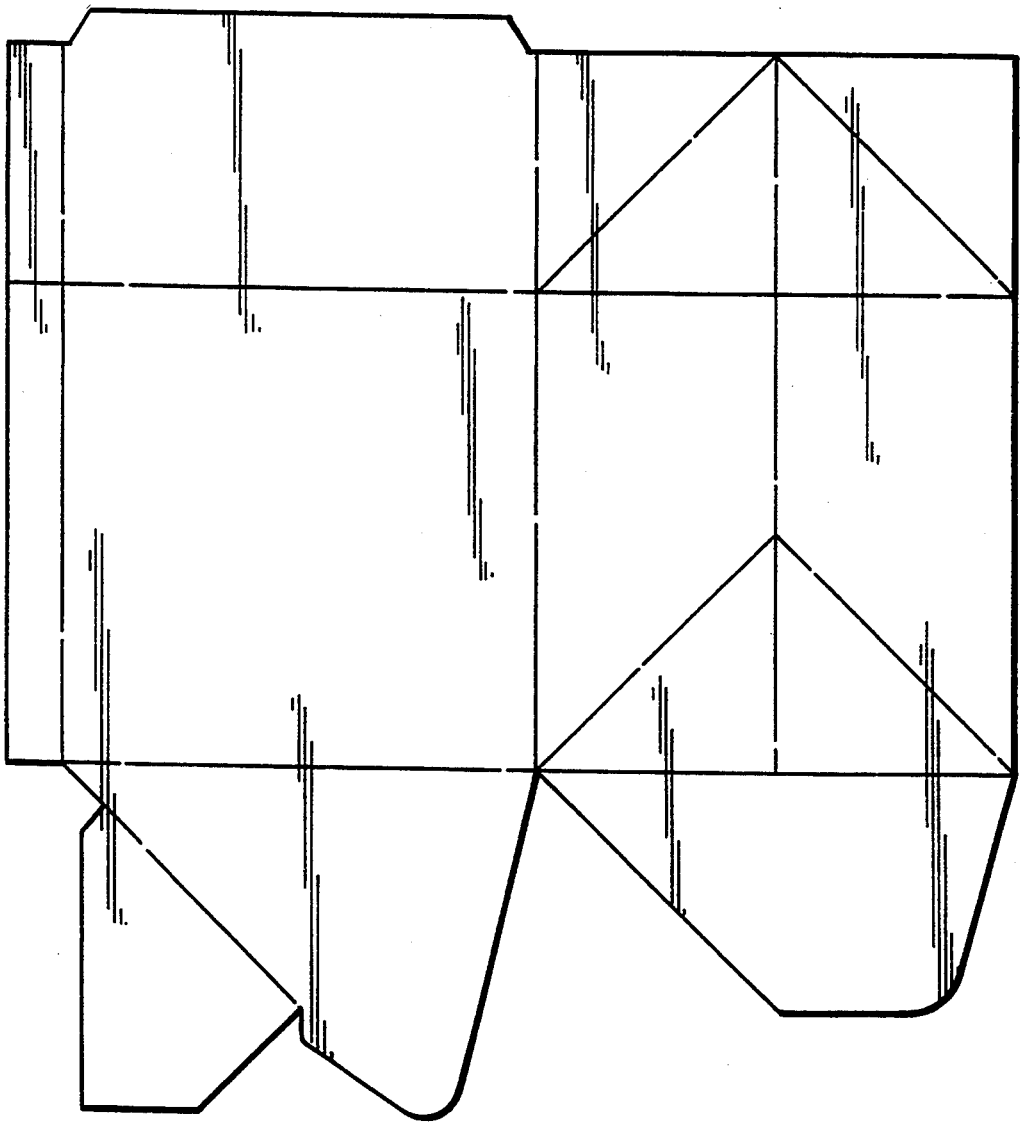
FIG. 7 is a plan view of one of a pair of identical cardboard blanks from which the carton of FIG. 6 is formed.

FIGS. 6 and 7 illustrate the application of the invention to a collapsible cubic shaped carton 27. In this case the rope handles are omitted but the arrangement is otherwise similar to that described with reference to FIGS. 1 to 5 above.

The arrangement of the invention provides a container particularly suitable for point of sale merchandise which is easily and swiftly closed to provide protection for the goods it contains. By way of example, the carrier bag form of the container would be particularly suitable for sale of shoes and the carton form of the container would be particularly suitable for the sale of food such as confectionery, horticultural products, pharmaceuticals, toiletries and the like.

Figure 8:
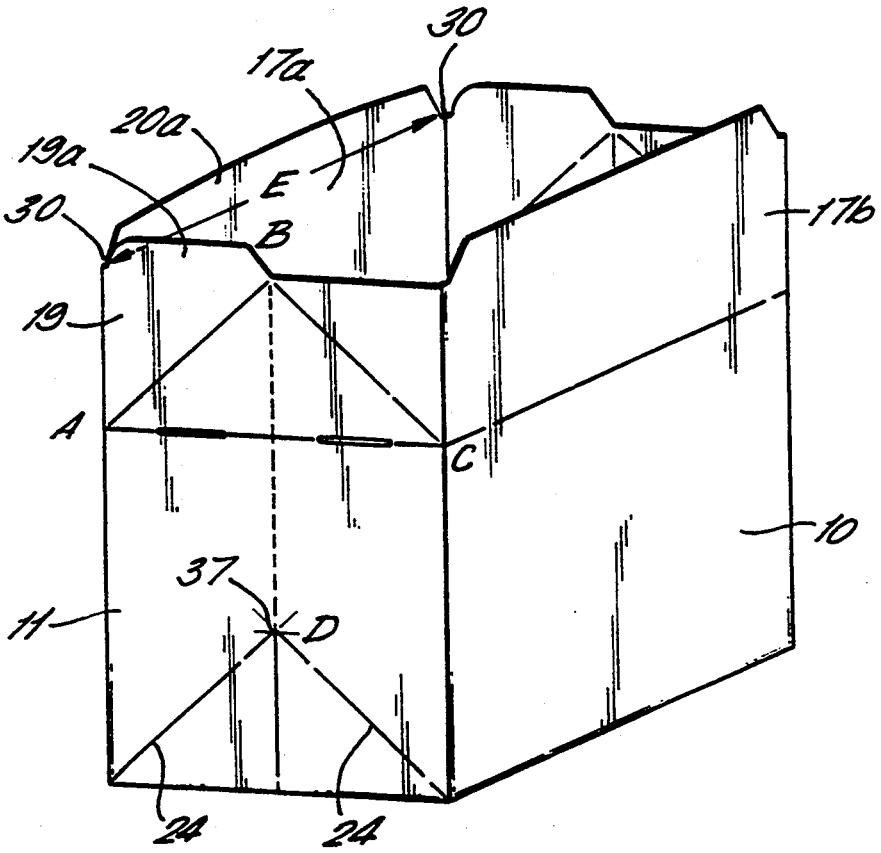
FIG. 8 is a perspective view of a modified form of the container of FIG. 1 with its top open.

The boxes described above have top closures 13 formed by two identical flap portions 17 formed with respective projecting edge tongues 20 which mean that the box can be closed with either of the flaps on top. This may be replaced by a mechanism which automatically determines which flap portion 17 is to be superior to the other. This is achieved as shown in FIG. 8 by enlarging the tongues 20*a* on the flap 17*a* intended to be uppermost and also adding tongues 19*a* to the wing portions 19 connected with the top flap 17*a*. To emphasise this further the tongue 20*a* top flap portion could be curved or formed in some identifiable way such as by the interlock 35 illustrated in FIG. 13 although this would not affect the closure. Tongue 20 may be omitted from the lower flap portion 17*b* which would then be straight cut.

Score cut creases to facilitate folding may be provided running along the wing flaps, from A to B and B to C as shown in FIG. 8 to facilitate folding down of the wing portions but these may be regarded as unattractive exposing board rather than ink and could be omitted.

The top flap portion 17*a* may also be widened at dimension E as shown on FIG. 8 to increase the downward pressure of the wing flaps at the centre crease line. This has however proved not essential. The addition of two small notches 30 cut into the corners between the top flap 17 and end flaps allow the lower portion of the top wall to slide more readily under the top wall. As the wings are folded downwardly to the horizontal, the wings hold the end walls flat but as soon as they pass below the horizontal the end walls can bow inwardly allowing the side walls to be drawn towards each other at the top of the container. As a result the wings are strongly biassed downwardly against the end walls of the container.

Another optional addition is to create a hole by four-way cuts 37 at the junction of the creases 24 which extend from the lower corners of the end wall to the centre line and the centre crease B to D as shown in FIG. 8. This creates a slot for the triangular wing flap to be tucked into. With improvements to the creasing this may be rendered unnecessary.

Figure 12A:
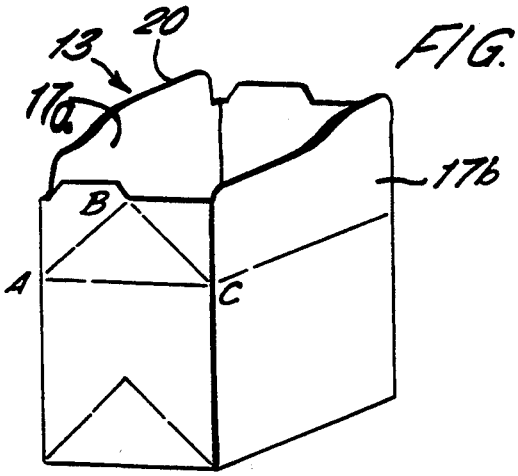
Figure 12B:
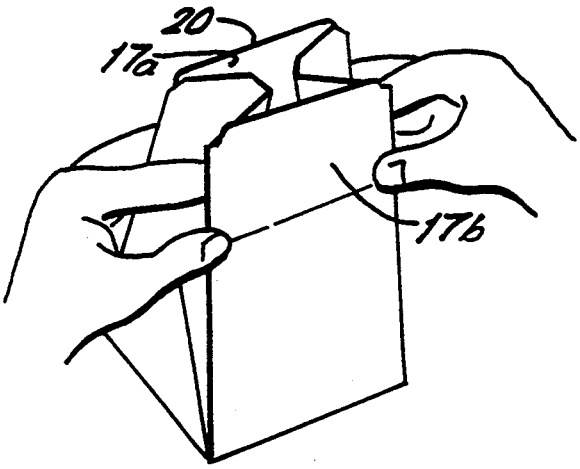
Figure 12C:
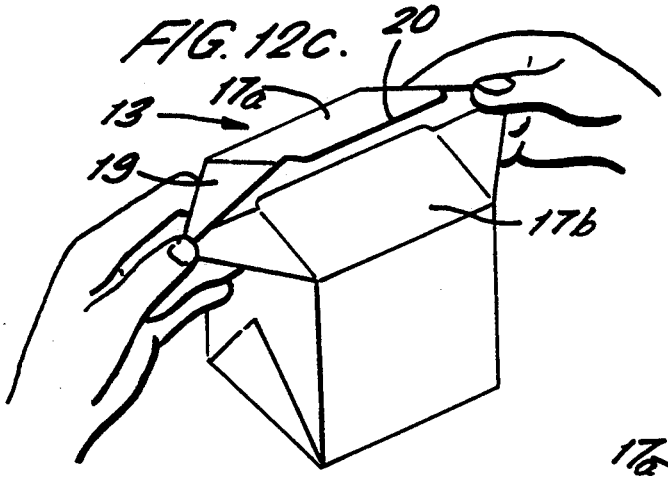
Figure 12D:
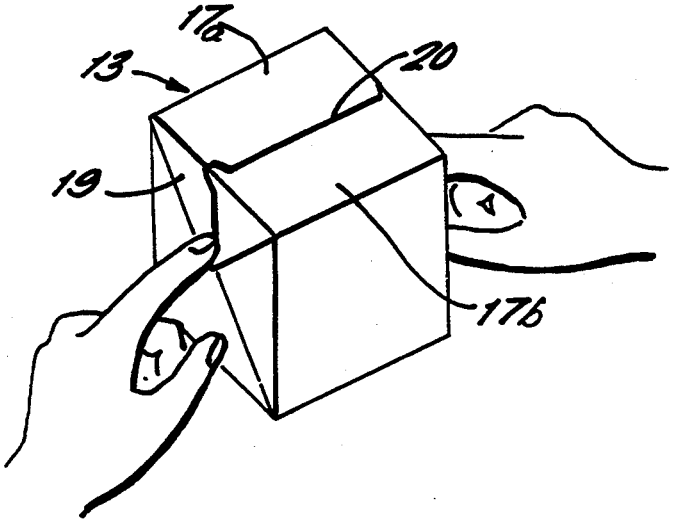

The crease running from B to D is perforated to improve the foldability to enable the end walls to be "cracked" by folding inwardly (as shown in FIG. 12*b*) before the top of the container is folded down. This pre-forms the end walls to bow inwardly more readily once the wing portions have passed below the horizontal allowing the side walls of the container to converge slightly as described earlier. This perforated crease may be replaced by a score line. Furthermore, the fold A–C between each end wall and its top flap is cut/scored to reduce resistance of the wing portions to being folded downwardly.

Figure 9:
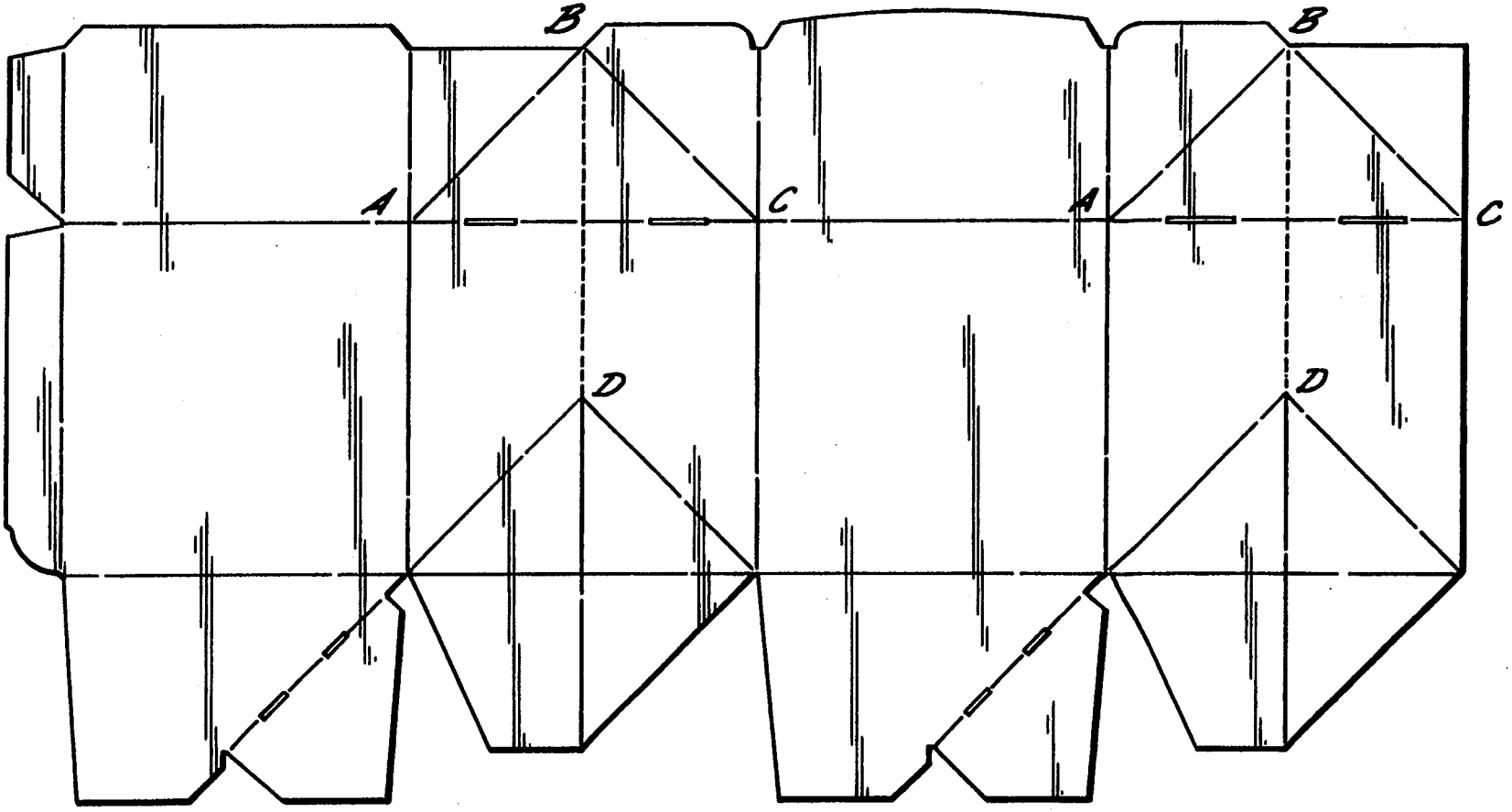
FIG. 9 shows a one piece blank from which the container of FIG. 8 is formed.
Figure 10:
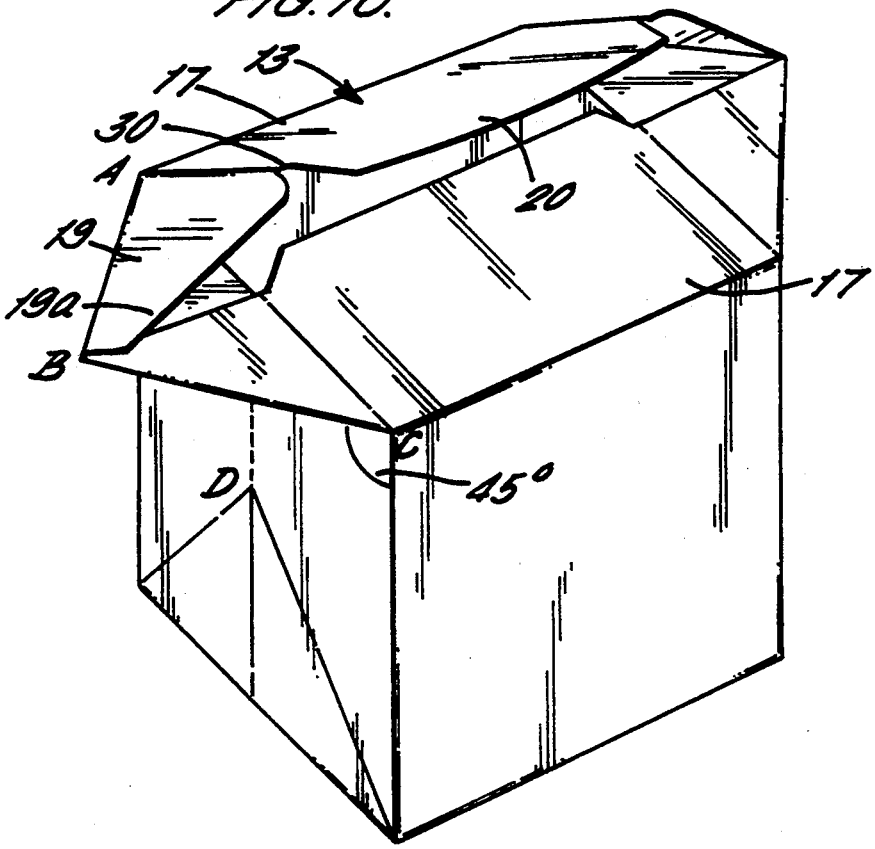
FIG. 10 illustrates the container of FIG. 8 with top closure partially closed.
Figure 11:
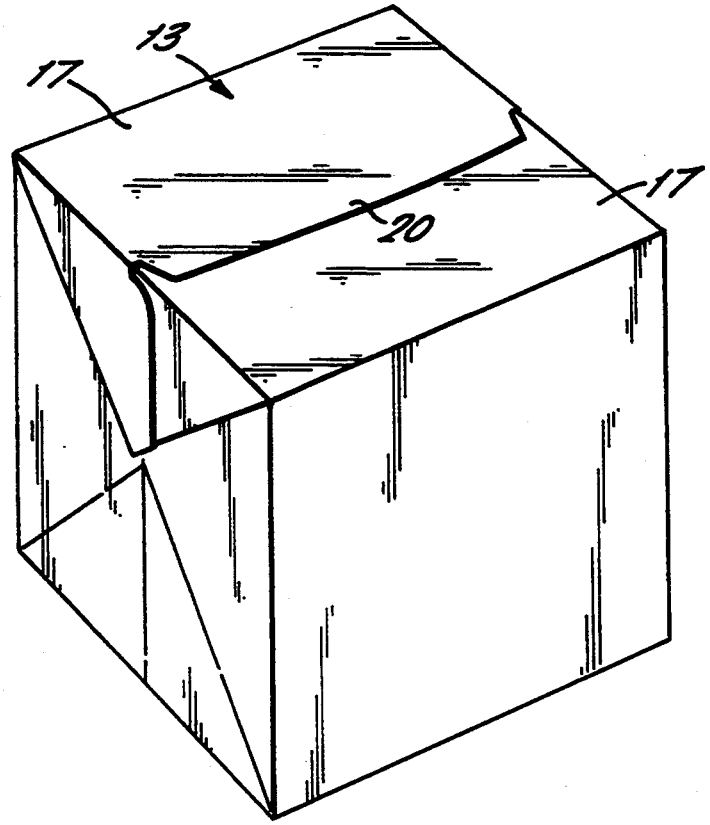
FIG. 11 illustrates the container of FIG. 8 with top closure of the container fully closed.

FIG. 9 shows the blank from which the container is formed.

Reference is now made to the illustrations of FIGS. 12*a* to 12*d* which show the closing of the container. In closing the top of the container, top flap 17*a* overlies the lower flap 17*b* which in turn overlies the top edges of the end walls of the container. The four walls of the cube create a rigid structure over which these layers of card have to extend.

As the triangular flaps are folded down the thickness of the card creates a tension across the length of top flap and between points A,B and C. The tension between these points creates a "spring" effect so that when the flaps are pushed down the tension is increased until the "spring" is at its most depressed. This point is approximately 45° downwardly from the horizontal. If the triangular flaps are released at this point they will 10 automatically "spring" open. At this point the pressure is equal between points A,B and C. Once pushed past this point the perforated crease B,D will collapse inwardly. The end walls become concave and the underside of the triangular flap becomes convex so that the flaps tuck neatly into the sides of the box.

As the perforated crease collapses the pressure on points A and C will relax and the energy passes to point B which snaps down into the sides of the box. The top flap slides simultaneously over the lower to accommodate this movement.

In a further embodiment of the invention (not illustrated) the flaps 17 are connected to the side walls by convexly curved creases to increase tension as the flaps are folded together to form the top closure.

Figure 14:
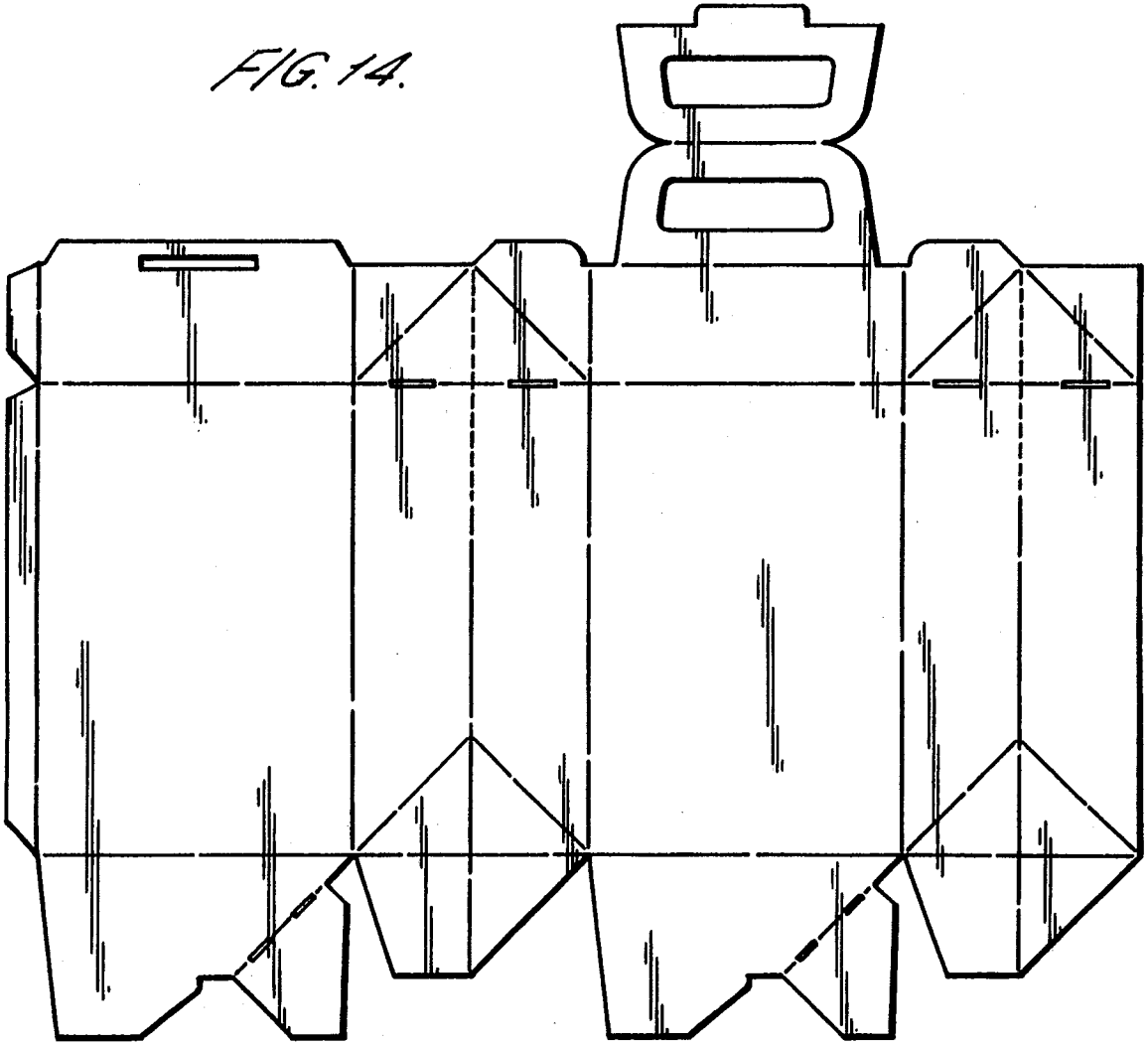
Figure 15:
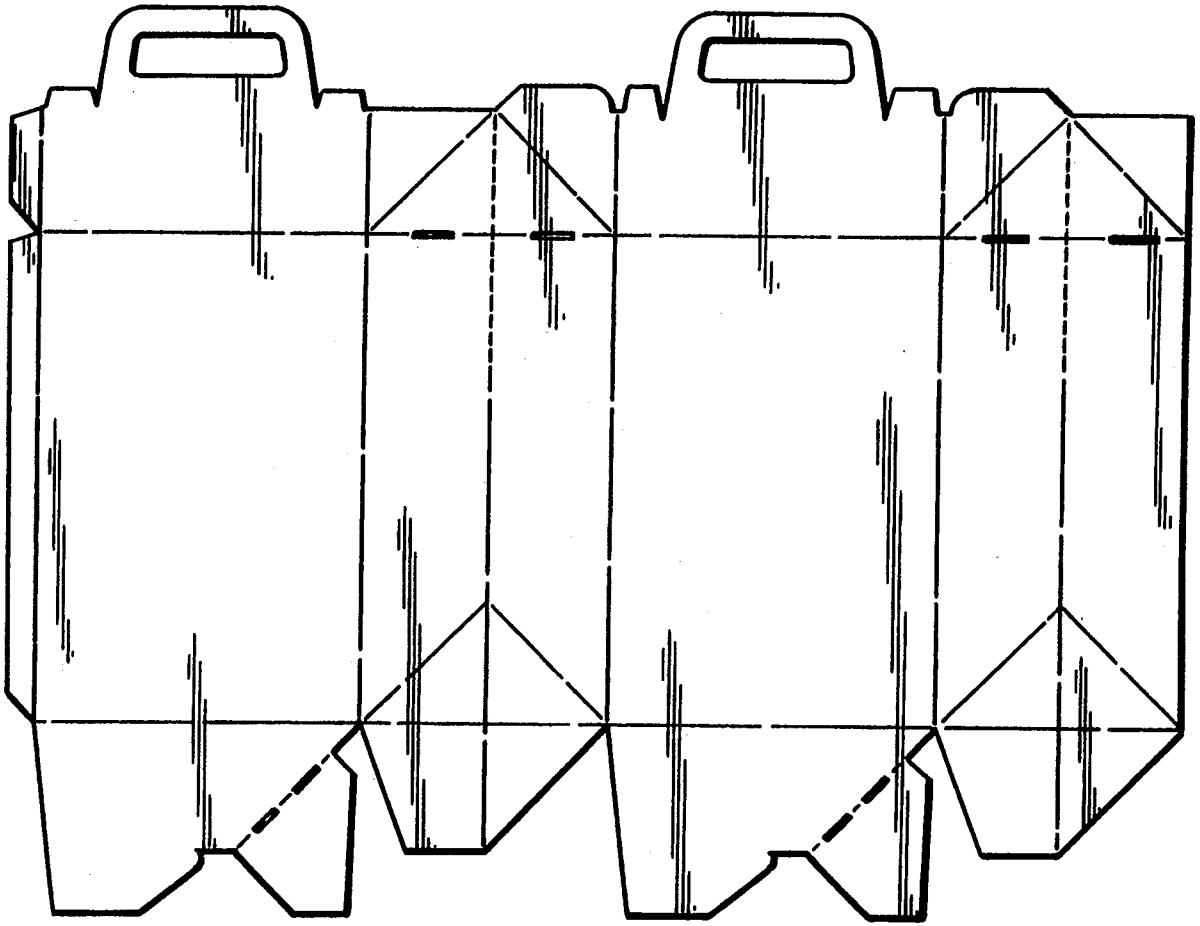

FIGS. 14 and 15 show blanks for forming containers with integral handles.

Figure 16:
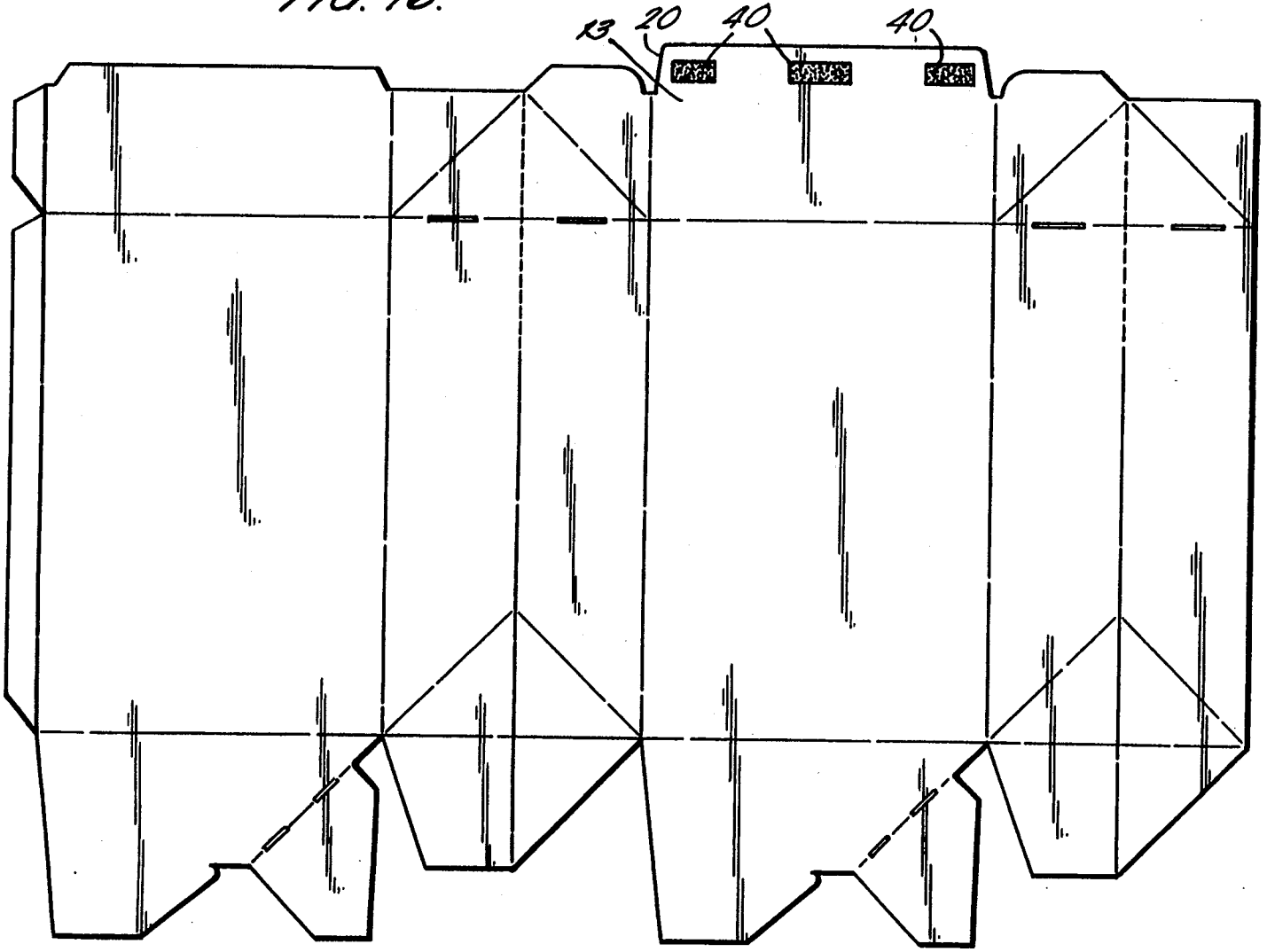
Figure 17:
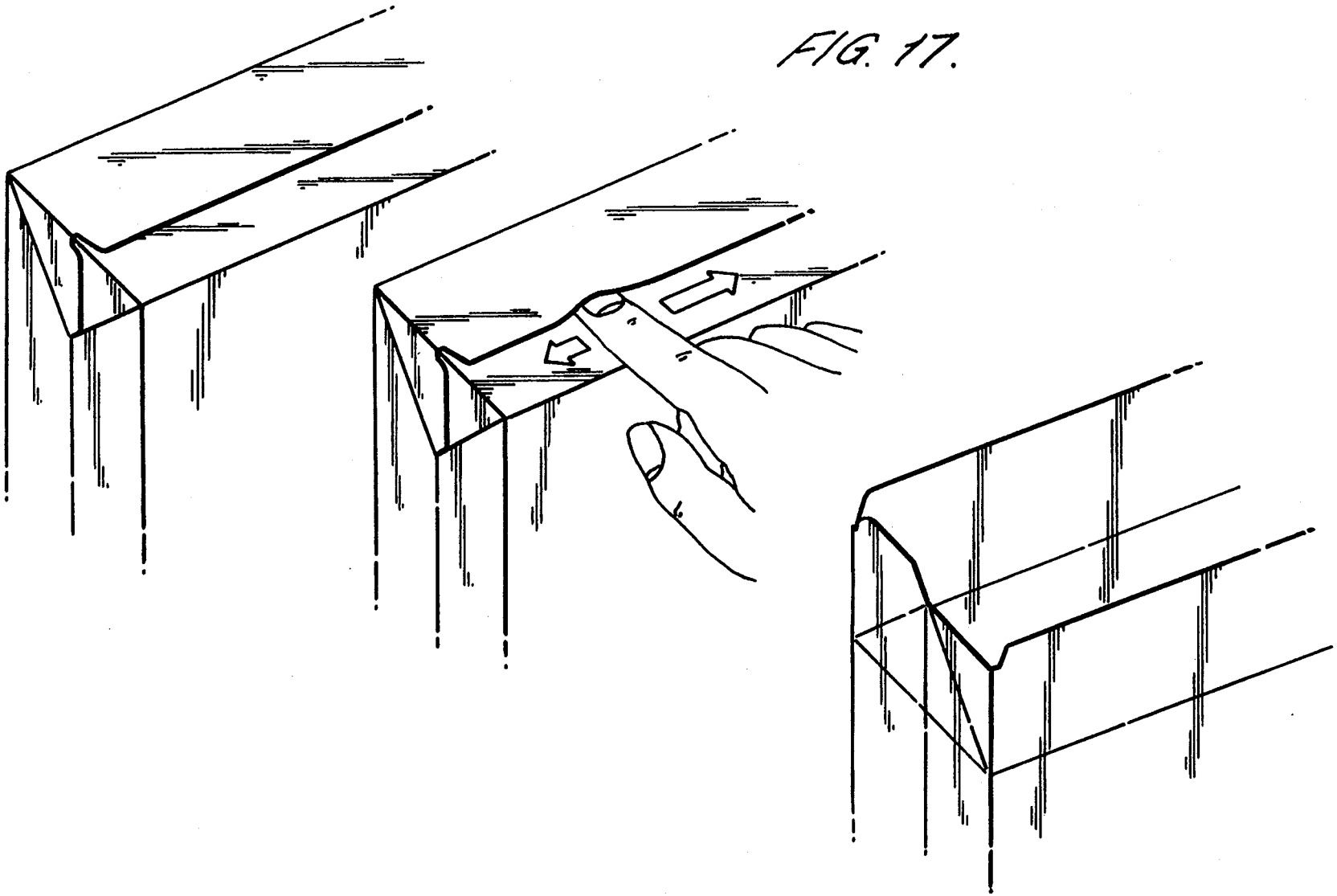
Figure 18:
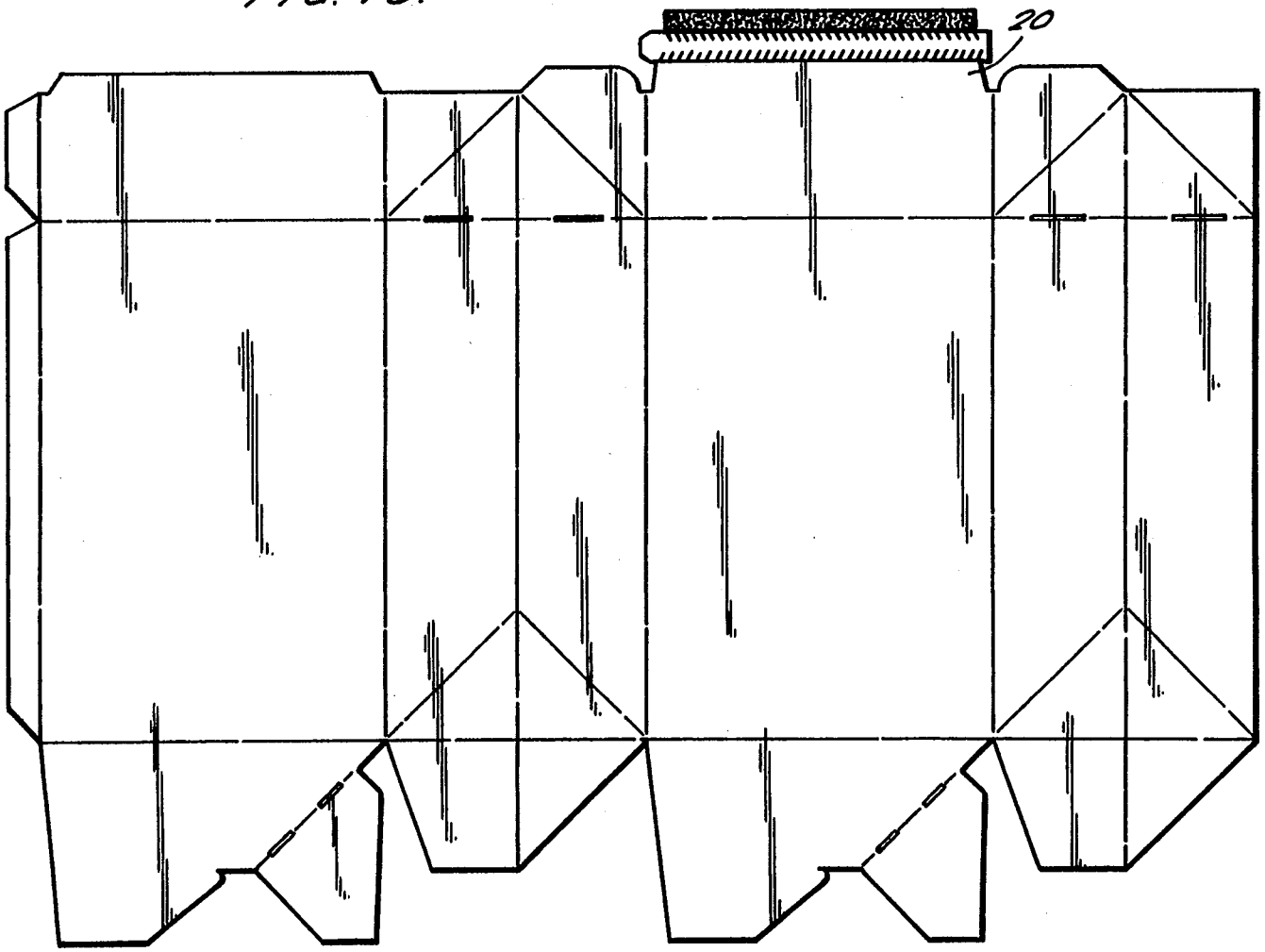
Figure 19:
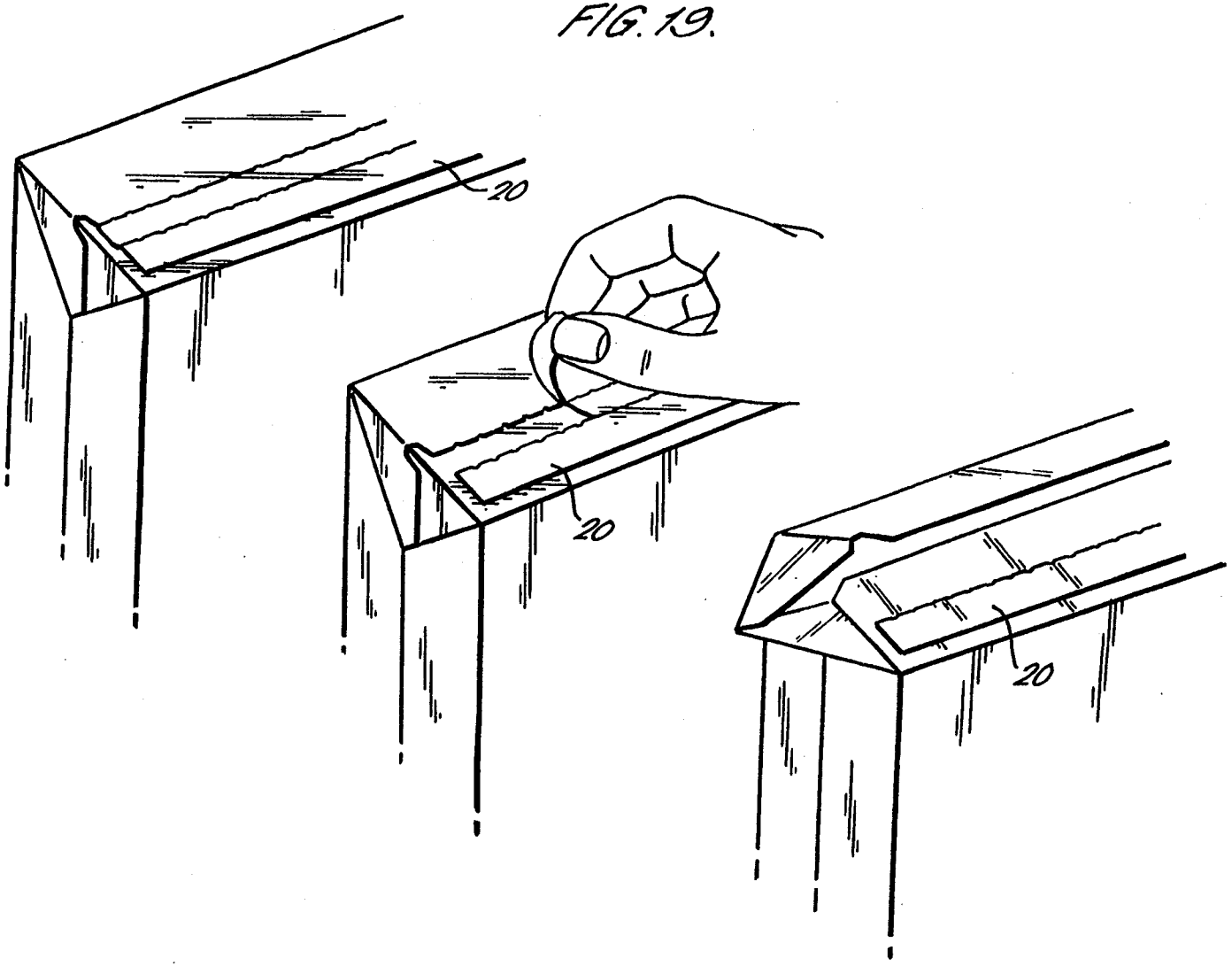
Figure 20:
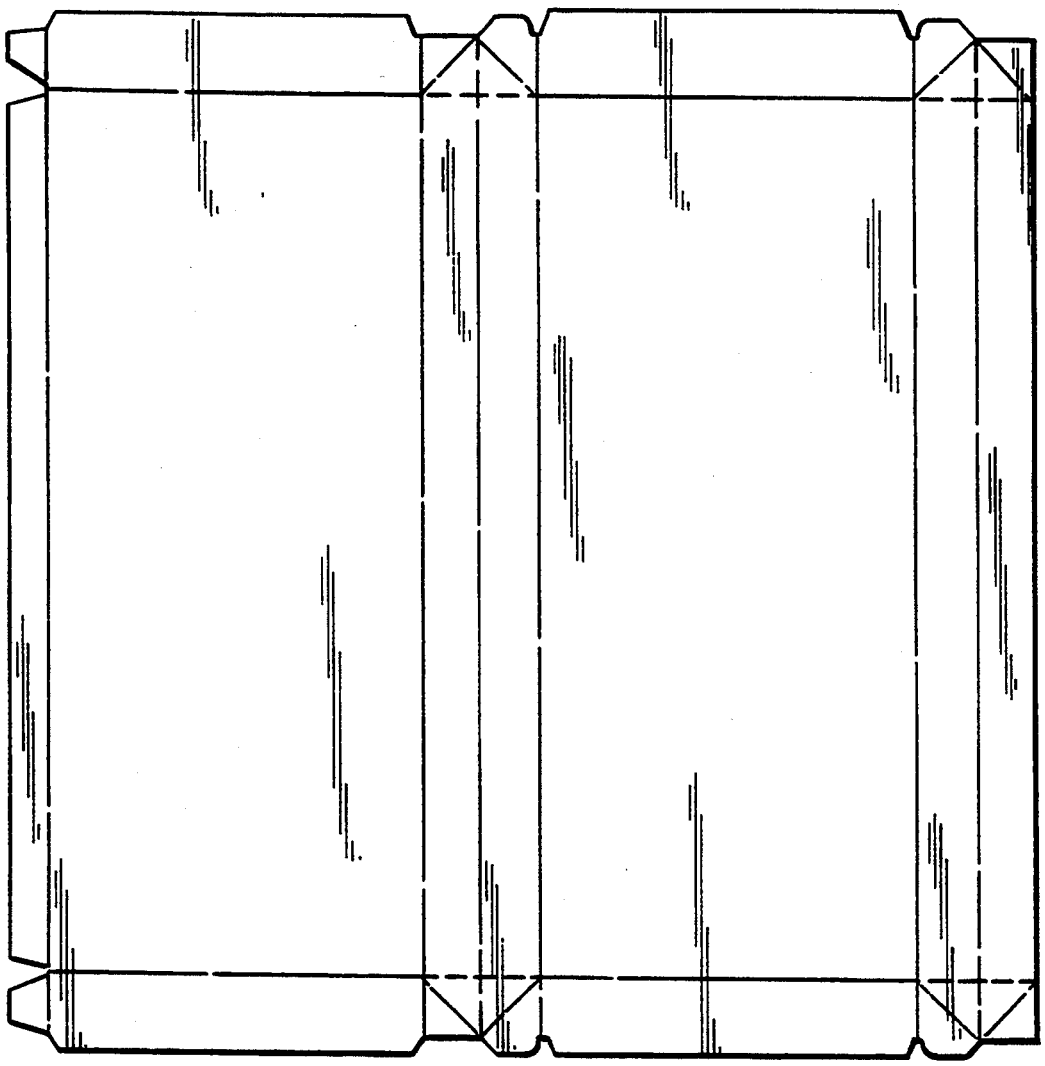
Figure 21:
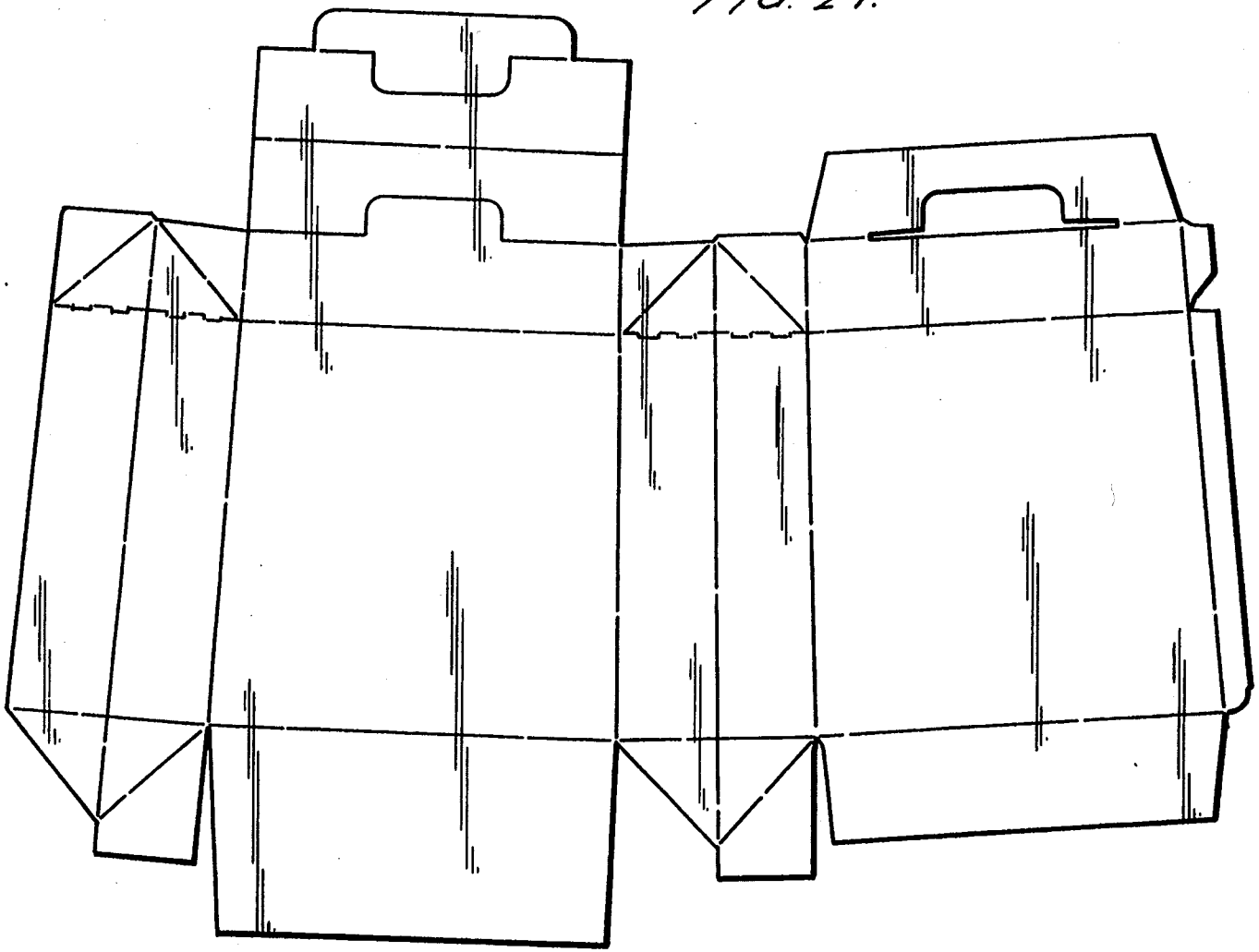
Figure 22:
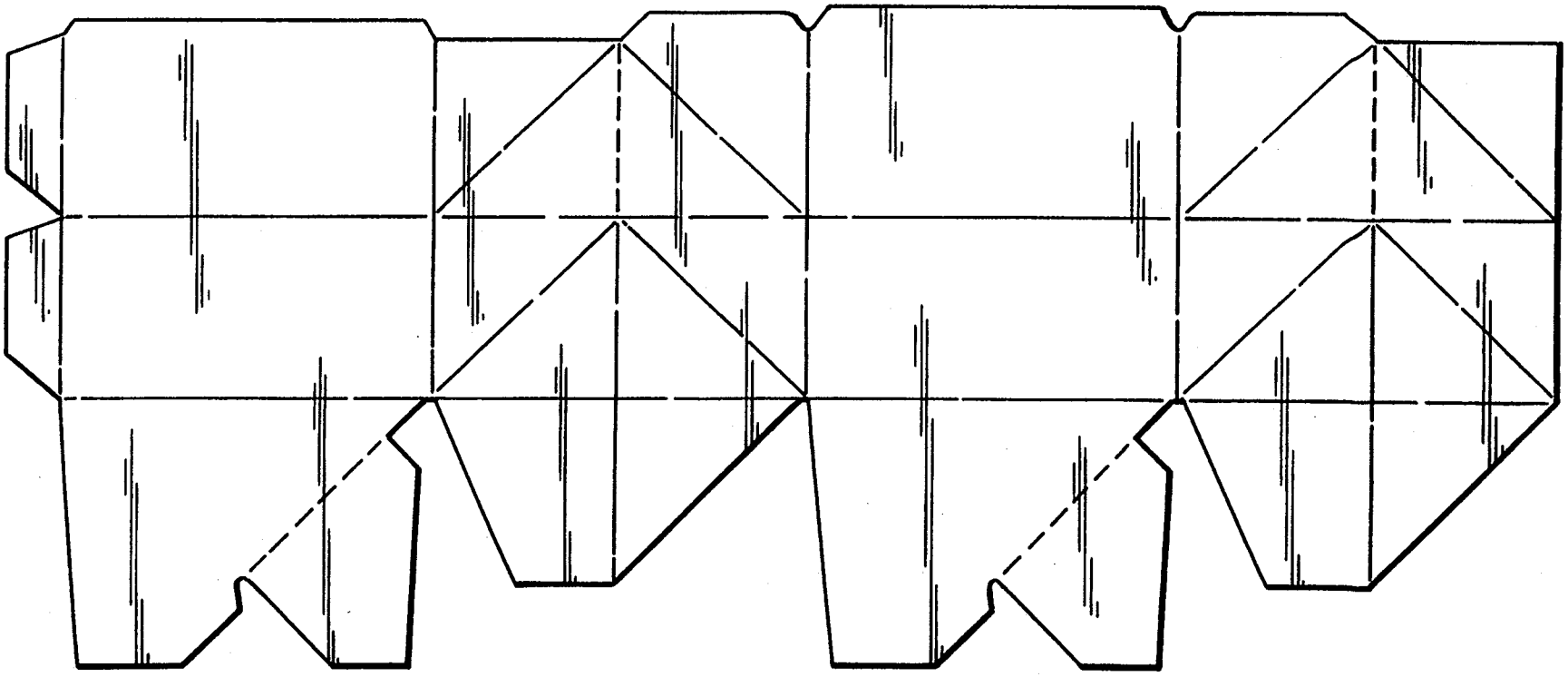

FIGS. 16 and 17 show a blank and an upper part of a corresponding container respectively in which the underside of the tongue 20 of the top flap 13 has adhesive patches 40 to adhere the top flap to the lower flap to seal the top closure of the container;

FIG. 18 shows a blank and FIG. 19 shows a corresponding upper part of a container in which the tongue 20 adheres to the flap below and is provided with a tear strip for holding the top part closed until released;

FIG. 20 shows a blank for a very narrow form of container;

FIG. 21 shows a blank for a tapered container;

FIG. 22 shows a blank for a very shallow container; and

Figure 23:
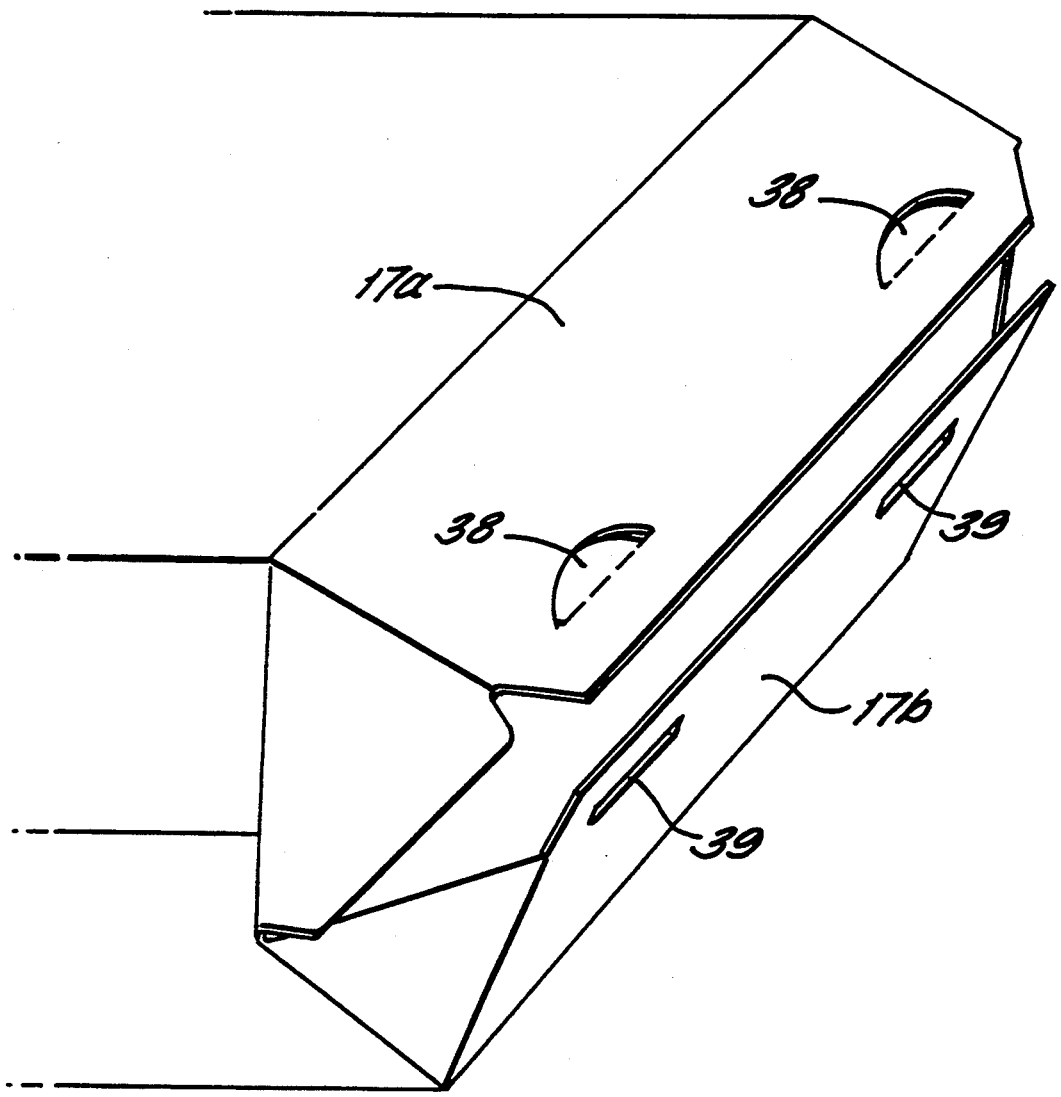

FIG. 23 shows an upper end of a container in which the top wall portions 17*a* and 17*b* are fitted with interlocking tabs 38 and slots 39 respectively to assist in holding the top walls closed particularly when the container is intended to hold heavy products.

Figure 24:
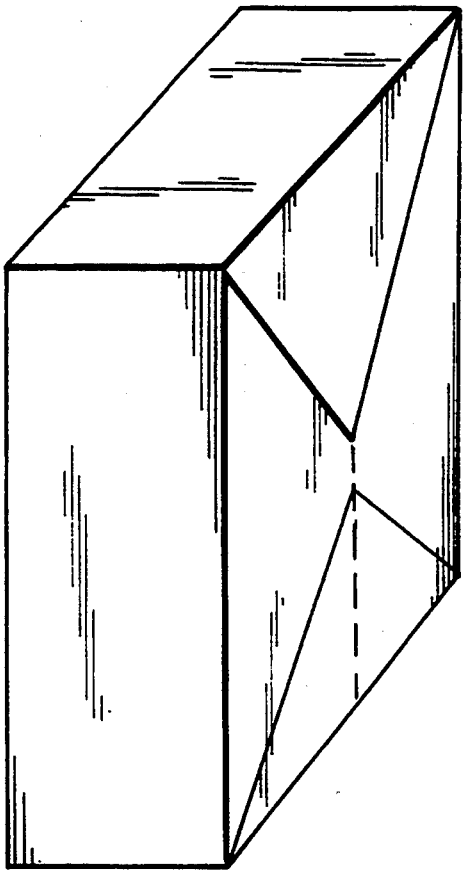
Figure 26:
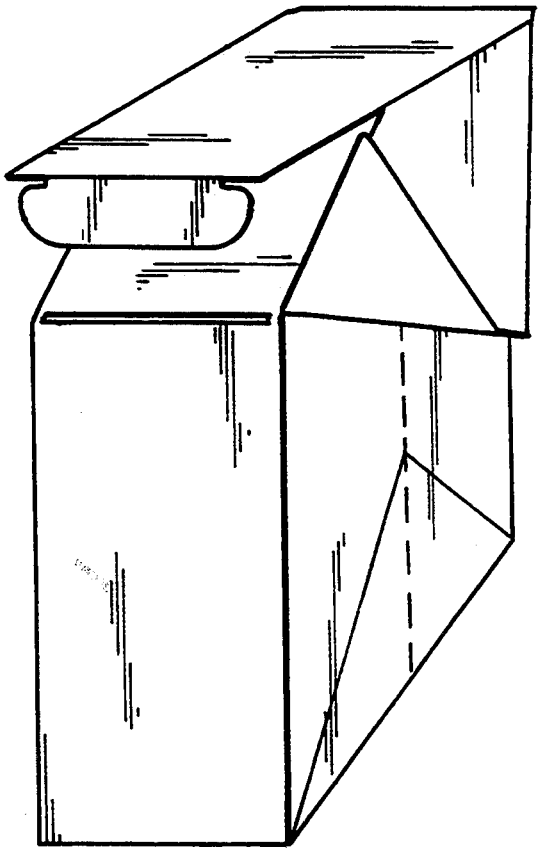
Figure 25:
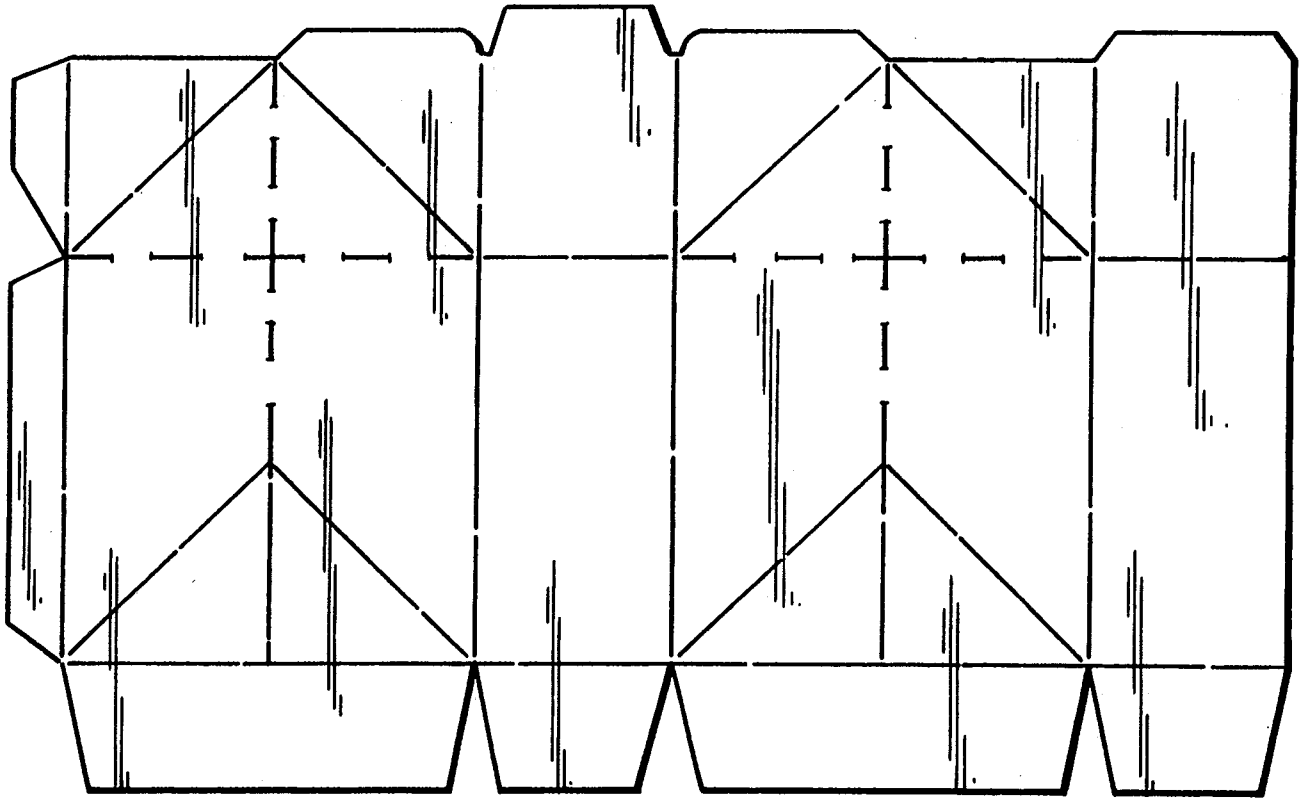
Figure 27:
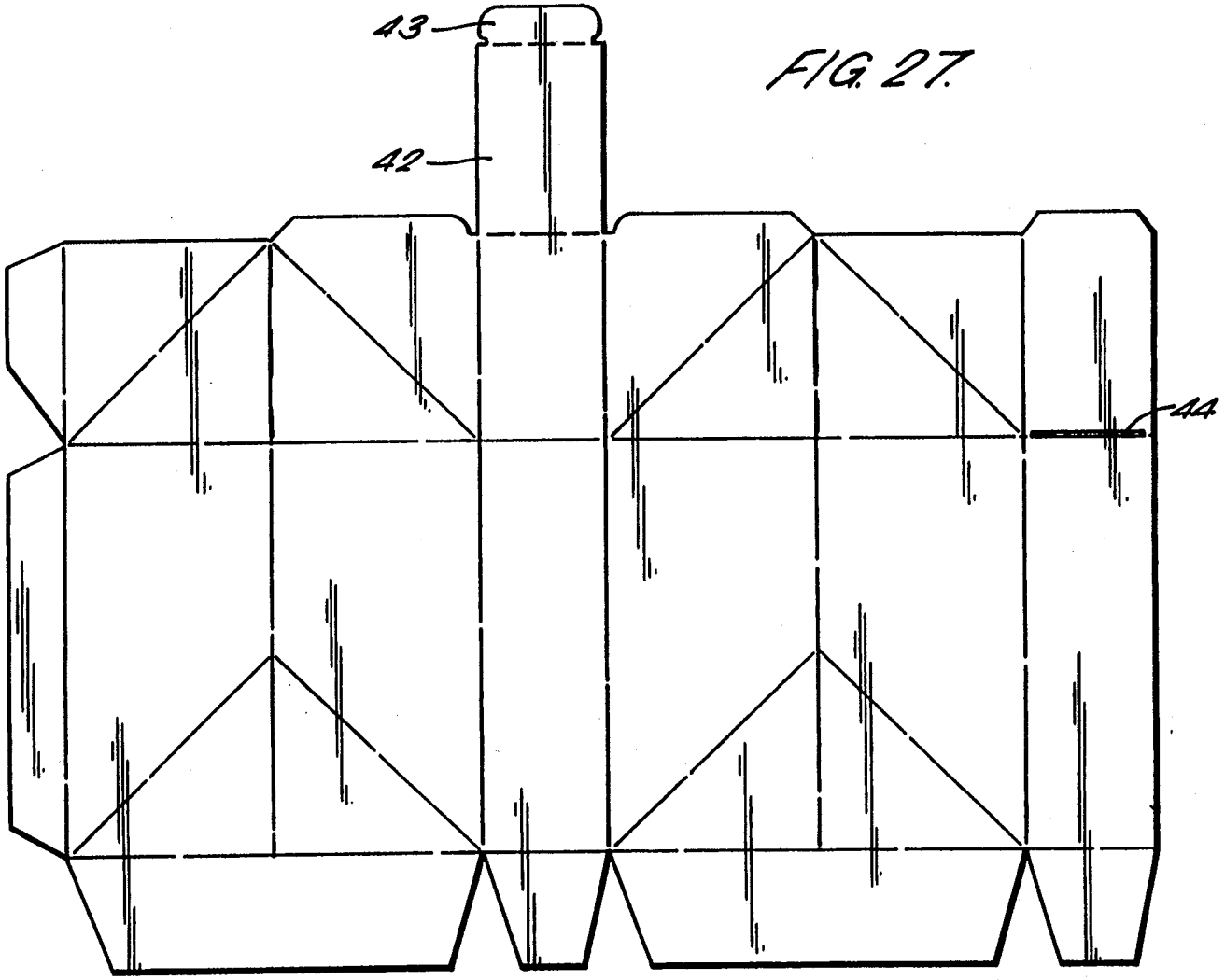

FIGS. 24 and 25 show a slim form of container and the blank for the container; and FIGS. 26 and 27 show a slim form of container as shown in FIG. 24 with the addition of top locking strip 42 formed integrally with one side wall of the container to extend over the top walls of the container and formed with an end tab 43 to engage in a slot 44 at the top of the opposite side wall.

I claim:

1. A merchandise container formed from folded flexible sheet material to provide a box form having side walls, end walls and a top closure, the top closure comprising side walls flaps which overlap to close the container and end wall flaps which are integral with the side wall flaps and form triangular wings on the end wall which can be folded downwardly to lie against the end walls, wherein the improvement comprises forming the end walls of the container with central crease lines extending lengthwise of the end walls from upper edges of said end wall flaps down the end walls to allow the end walls to bow inwardly into a concave formation so that as the wings are folded downwardly through horizontal towards the end walls, the end walls can bow inwardly to cause the side walls to converge towards one another, thereby causing the wings to be biased downwardly against the end walls of the container, which are inwardly bowed, to hold the side wall flaps over a top opening of the container in closed, overlapping condition.

2. A container as claimed in claim 1, wherein said central crease lines extend to bottom edges of the end walls.

3. A container as claimed in claim 2, wherein said central crease lines are also perforated at least through the top flaps of the end walls.

4. A container as claimed in claim 3, wherein the central crease lines are perforated at least part-way down the end walls.

5. A container as claimed in claim 4, wherein the end walls of the container have further crease lines extending from lower corners of the end walls upwardly and inwardly to meet said central crease lines at an apex.

6. A container as claimed in claim 5, wherein said further crease lines extend at 45° to the bottom edges of the end walls.

7. A container as claimed in claim 5, wherein the central crease lines are perforated down to said apex with said further crease lines.

8. A container as claimed in claim 5, wherein the central crease lines are perforated down to a location above the apex with the further crease lines.

9. A container as claimed in claim 1, wherein cut/score lines are formed between the top flaps and end walls to weaken substantially the resistance to folding of the top flaps.

10. A container as claimed in claim 1, wherein the end wall flaps are each formed with a triangle of pre-creased fold lines to facilitate formation of said triangular shaped wing portions when the side wall flaps are folded together.

11. A container as claimed in claim 1, wherein notches are cut at the corners between the uppermost side wall flap and adjacent end wall flap to facilitate sliding of the upper side wall flap over the lower side wall flap and thereby to facilitate movement of the sides of the container towards each other as the end walls of the container bow inwardly when the wing portions are folded downwardly.

12. A container as claimed in claim 1, wherein the flap portions have integral tongues which project above the edges of the adjacent wing portions prior to folding of the flaps/wings, the tongues overlapping one another when the flaps are folded downwardly and inwardly to create the top closure of the container.

13. A container as claimed in claim 1, wherein the sheet material of the container is a stiff paper, card or plastic sheet.

* * * * *

UNITED STATES PATENT AND TRADEMARK OFFICE

CERTIFICATE OF CORRECTION

PATENT NO. : 5,413,273

DATED : May 9, 1995

INVENTOR(S) : Julian D. Money

It is certified that error appears in the above-identified patent and that said Letters Patent is hereby corrected as shown below:

Col. 4, line 64, delete "10".

Col. 6, claim 5, line 16, change "4" to --2--.

Signed and Sealed this

Sixteenth Day of April, 1996

Bruce Lehman

*Attest:*

BRUCE LEHMAN

*Attesting Officer*

*Commissioner of Patents and Trademarks*